US006488243B2

(12) United States Patent
Kim

(10) Patent No.: US 6,488,243 B2
(45) Date of Patent: Dec. 3, 2002

(54) BAG HOLDER FOR HANGING ON RIMS OF MISCELLANEOUS ITEMS

(76) Inventor: Seong Tae Kim, 3700 Wilshire Blvd. Suite 1000, Los Angeles, CA (US) 90010

( * ) Notice: Subject to any disclaimer, the term of this patent is extended or adjusted under 35 U.S.C. 154(b) by 0 days.

(21) Appl. No.: 09/826,788

(22) Filed: Apr. 6, 2001

(65) Prior Publication Data

US 2002/0145087 A1 Oct. 10, 2002

(51) Int. Cl.[7] ..... B65B 67/12; B65B 67/04
(52) U.S. Cl. ..... 248/100
(58) Field of Search ..... 248/100, 99, 95, 248/214, 175; 220/495.06; 383/33

(56) References Cited

U.S. PATENT DOCUMENTS 3,220,434 A * 11/1965 Garth ..... 248/99
3,838,839 A * 10/1974 Spencer ..... 248/99
4,487,388 A * 12/1984 Provan ..... 248/97
4,579,307 A * 4/1986 Malik ..... 248/99
4,840,335 A * 6/1989 Forman ..... 248/97
4,858,862 A * 8/1989 Prader ..... 248/99
5,012,994 A * 5/1991 Keefe ..... 248/558
5,040,755 A * 8/1991 Dineen ..... 248/99
5,380,081 A * 1/1995 Vogt ..... 312/212

* cited by examiner

*Primary Examiner*—Ramon O. Ramirez
*Assistant Examiner*—Amy J. Sterling
(74) *Attorney, Agent, or Firm*—Jerry H. Noh

(57) ABSTRACT

A bag holder comprising a pair of elongated vertical side members connected by a lower support bar and an upper brace member. An arm member forwardly extends from an upper end of each of the side members. Each arm member is formed into an upwardly extending horizontally elongated tab with a rearwardly projecting protrusion and a bent nose. The brace member has a rearwardly and downwardly extending middle portion, and a rod member extends perpendicularly and rearwardly from each end of the brace member. The device can further have a removeable cover member fitting over the arms.

20 Claims, 7 Drawing Sheets

BAG HOLDER FOR HANGING ON RIMS OF MISCELLANEOUS ITEMS

FIELD OF THE INVENTION

This invention relates to a device for holding bags, more specifically, this invention relates to a device for holding waste or storage bags which can be removeably mounted on desks, drawers, or on the edge rims of miscellaneous items.

DESCRIPTION OF THE PRIOR ART

Market bags of the plastic type having two looped handles given out in most supermarkets and grocery stores are utilized by many as waste bags.

When used in the stores, the bags hold grocery and other items. The bags are held on a rack holder such as that taught in U.S. Pat. Nos. 4,487,388 and 4,332,361. The rack holders are design to stand on their own and hold bulk quantities of pressed bags which can be opened one by one to load goods therein.

When brought home, the market bags can be recycled as waste bags. These bags are typically placed inside small waste baskets. Some people just hang the bags by the looped handle to protruding knobs or handles on drawers or doors. When used in small wastebaskets or hung on objects by the handles, the full volume of the bags cannot be utilized as a trash source.

Thus it is a primary object of the present invention to provide a bag holder which utilizes the full volume of the bag. Another object of the present invention is to provide a bag holder which can be hung on the edge of drawers and other items. Another object of the present invention is to provide a bag holder which is inexpensive to manufacture.

SUMMARY OF THE INVENTION

The present invention is a bag holding device which can be hung on rims of miscellaneous items including edges of drawers and cabinets. The bags utilized with this device has a pair of opposed upwardly extendable loop handles, and the holder comprises a pair of elongated vertical side members. A brace member horizontally connects the pair of vertical side members, and an arm member forwardly extends from an upper end of each of the side members. Each arm member is formed into an upwardly extending horizontally elongated tab with a rearwardly projecting protrusion and a bent nose. Also, the brace member has rearwardly and downwardwardly extending middle portion for hooking onto the rim of miscellaneous items. In use with a bag, a user places each of the looped handles of the bag on a corresponding one of the arm portion tabs.

The holder further can comprise a support bar connecting the lower ends of the side members. Also, the holder further can comprise a rod member extending perpendicularly and rearwardly from each end of the brace member for lateral balance. The device can further have a removeable cover member fitting over the arms.

DETAILED DESCRIPTION OF THE PREFERRED EMBODIMENT

Figure 1:
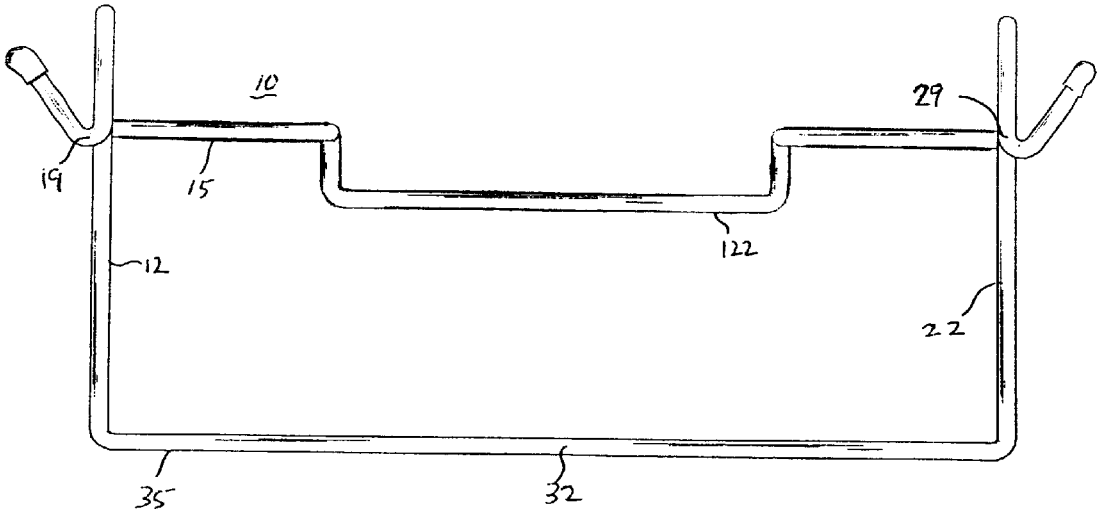
FIG. 1 is a front view of the present invention.
Figure 2:
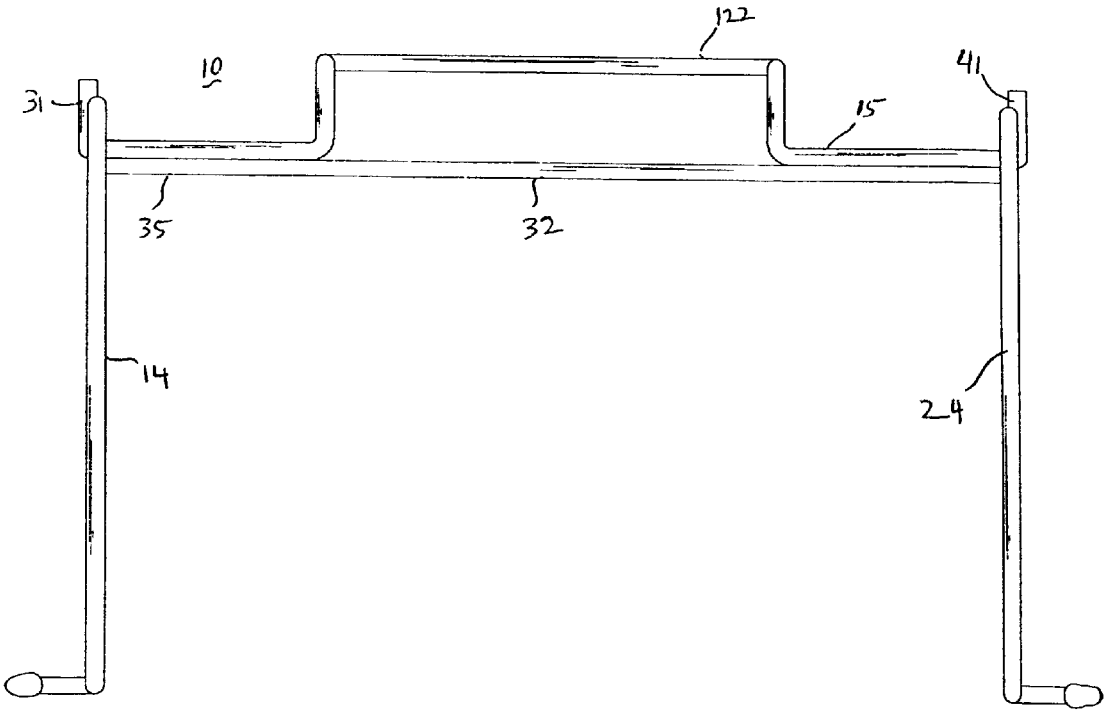
FIG. 2 is a top view of the present invention.
Figure 3:
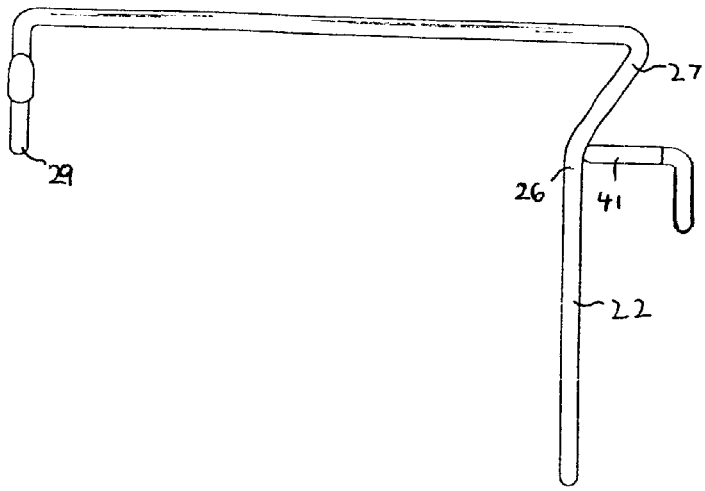
FIG. 3 is a side view of the present invention.

The present invention illustrated in FIGS. 1 to 10 is a bag holder 10 for hanging on a rim of miscellaneous items including edges of cabinet doors and table drawers. Once hung on such items, the device holds bags of the kind having a pair of opposed upwardly extendable loop handles and the user can utilize the bags and holder as a waste bag or other storage purpose. The holder 10 comprises a pair of elongated vertical side members 12, 22 joined by a horizontally extending brace member 15. An arm member 14, 24 forwardly extends from an upper end 16, 26 of each of the side members 12, 22. Each arm member 14, 24 is formed into an upwardly extending horizontally elongated tab with a rearwardly projecting protrusion 17, 27 and a bent nose 19, 29. The brace member 15 has rearwardly and downwardwardly extending middle portion 122 for hooking onto the rim of miscellaneous items. In use with a bag 130 as shown in FIG. 4*a* and 4*b*, a user places each of the looped handles 110, 120 of the bag 130 on a corresponding one of the arm portion tabs. The side members 12, 22, arm member 14, 24, and brace member 15 can all be made of a durable, rigid material such as steel, metal alloy, graphite, iron, brass, or aluminum.

For further support of the vertical side members 12, 22, a support bar 32 can be added to connect the side members below the brace member 15. For horizontal balance a rod 31, 41 protrudes rearwardly from the ends of the brace member 15.

Figure 5:
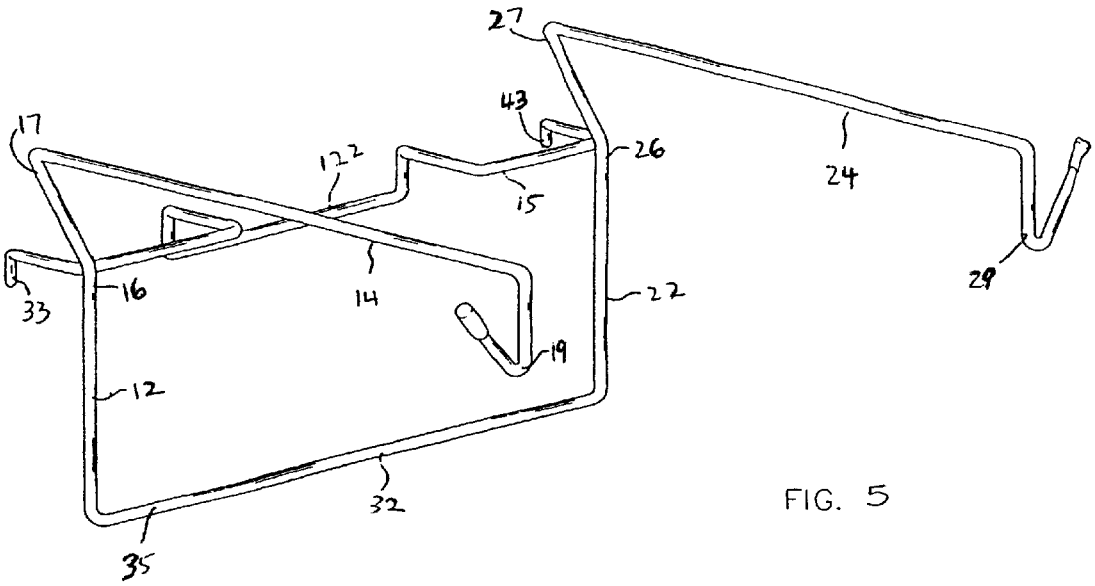
FIG. 5 is a perspective view of an alternative embodiment of the present invention.
Figure 6:
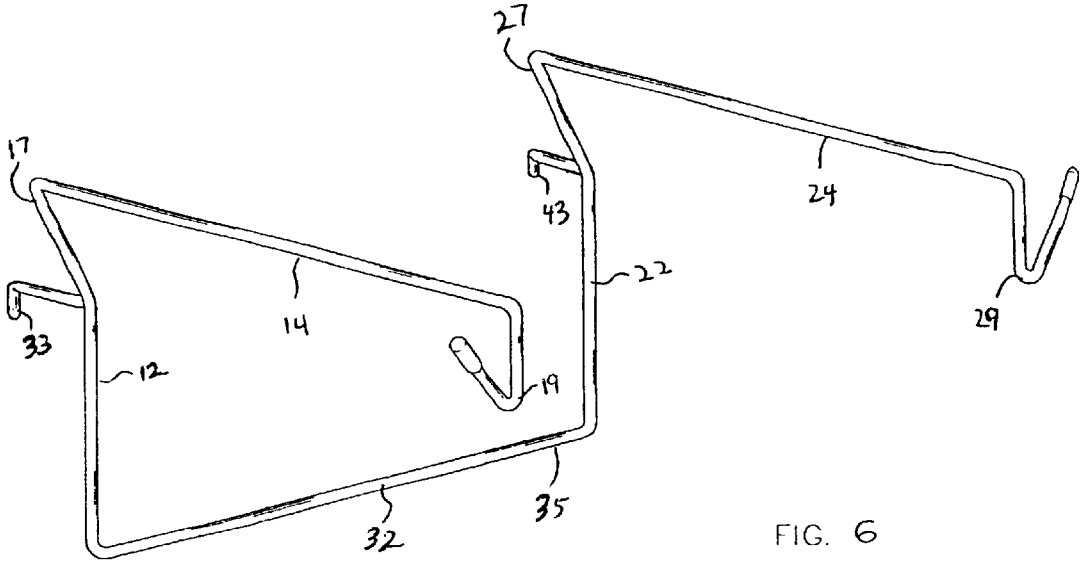
FIG. 6 is a perspective view of an another alternative embodiment of the present invention.
Figure 7:
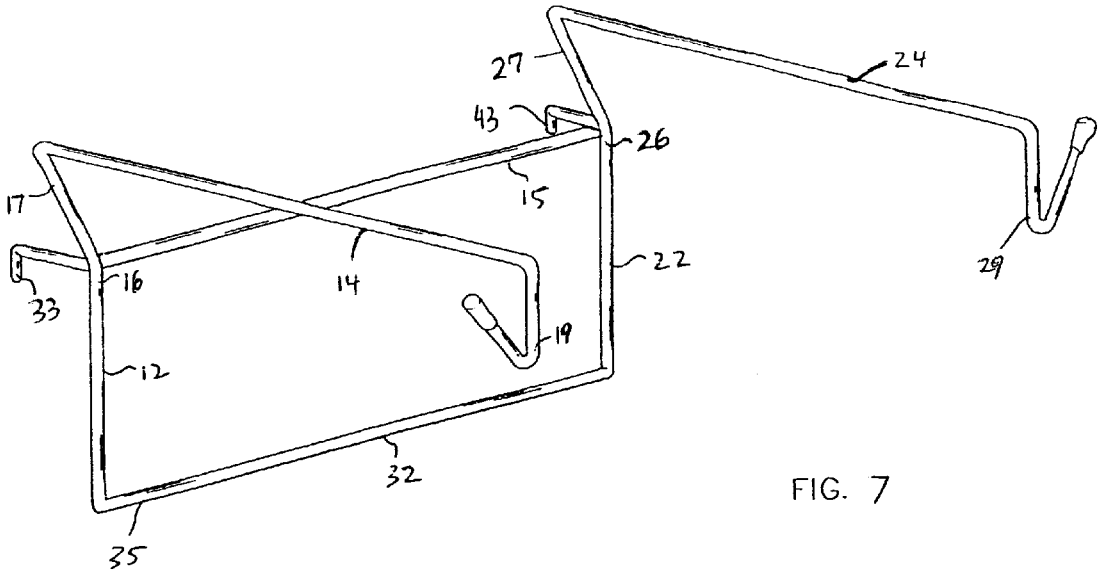
FIG. 7 is a perspective view of another alternative embodiment of the present invention.
Figure 8:
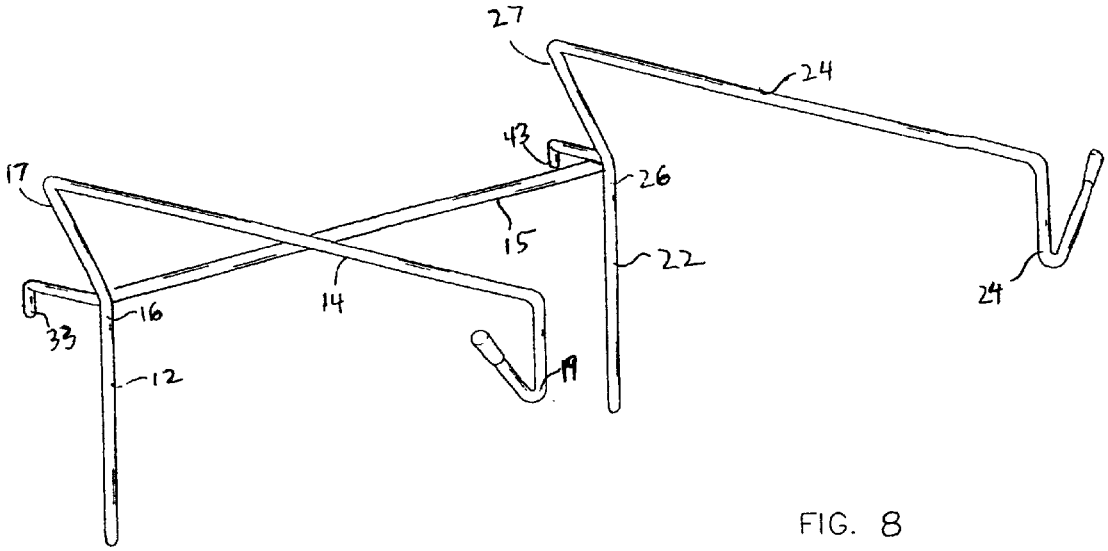
FIG. 8 is a perspective view of yet another alternative embodiment of the present invention.

In an alternative embodiment as best shown in FIGS. 5 to 7, the holder 10 comprises a continuous durable and rigid wire 35 bent to form a support bar 32 and a spaced pair of upwardly extending vertical side members 12, 22 having an arm member 14, 24 formed into an upwardly extending horizontally elongated tab with a rearwardly projecting protrusion 17, 27 and a bent nose 19, 29. At a predetermined distance below the arm member 14, 24, each side member 12, 22 has a rearwardly protruding rod member 31, 41 having a downwardly protruding portion 33, 43 for hooking onto the rim of miscellaneous items. Also, this embodiment can further comprise a substantially straight brace member 15 connecting the side members 12, 22. In the alternative, the brace member 15 can comprise the rearwardly and downwardwardly extending middle portion 122 for hooking onto rim of miscellaneous items. The wire 35 can be made of a durable, rigid material such as steel, metal alloy, graphite, iron, brass, or aluminum.

Figure 9:
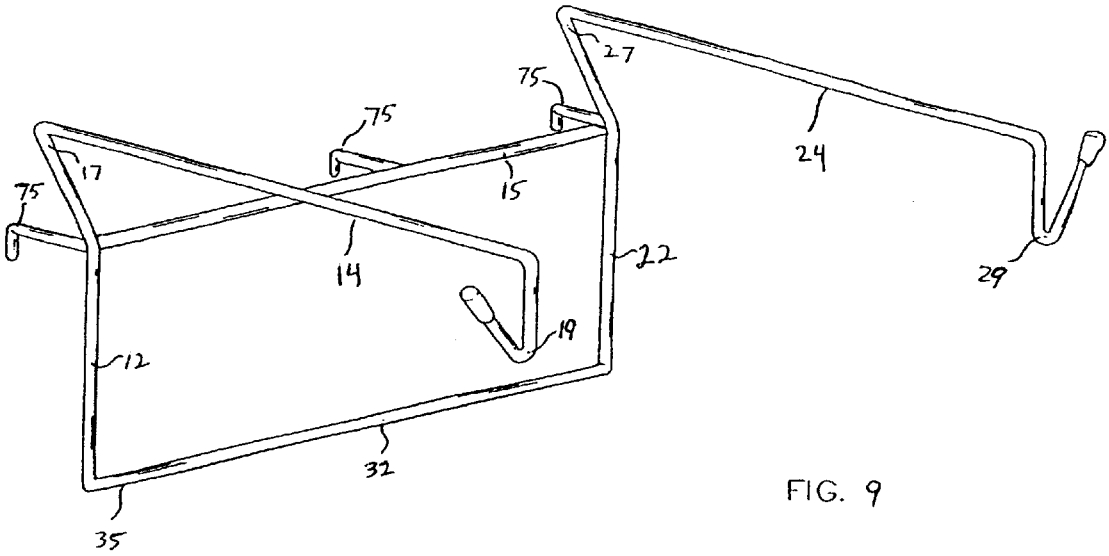
FIG. 9 is a perspective view of another alternative embodiment of the present invention.
Figure 10:
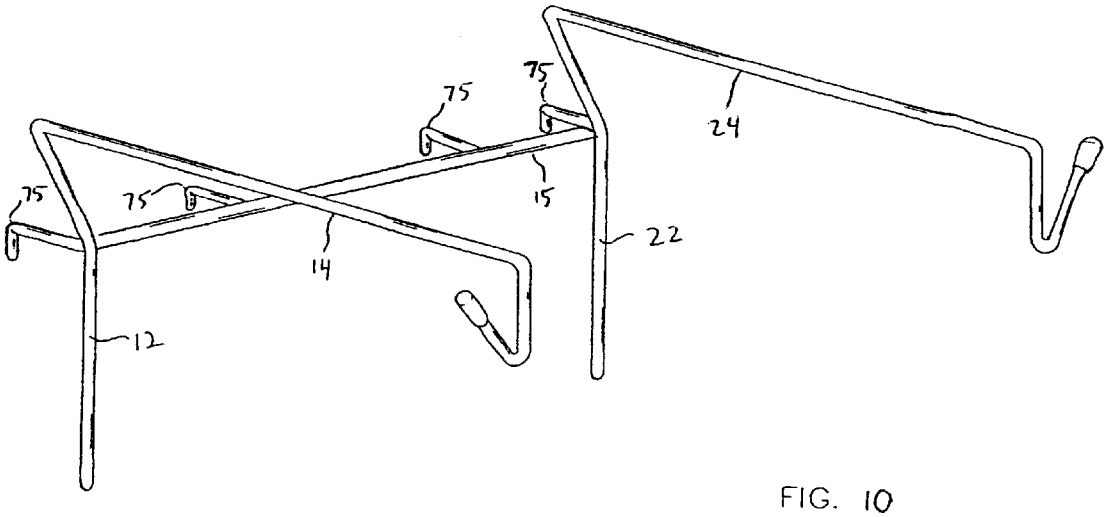
FIG. 10 is a perspective view of yet another alternative embodiment of the present invention.

In yet another embodiment, the holder 10 comprises a continuous durable and rigid wire 35 bent to form support bar 32 and a spaced pair of upwardly extending vertical side members 12, 22. The wire 35 arm member 14, 24 forwardly extending from an upper end 16, 26 of each of the side members 12, 22. The arm member 14, 24 is formed into an upwardly extending horizontally elongated tab with a rearwardly projecting protrusion 17, 27 and a bent nose 19, 29, and a brace member 15 horizontally connects the pair of vertical side members 12, 22 at a predetermined distance below the arm member 14, 24. Also the holder 10 has a means for hooking the holder onto the rim of miscellaneous items which can be two or more spaced rod members 75 extending rearwardly and downwardly from the brace member 15 as shown in FIGS. 9 and 10. The wire 35 can be made of a durable, rigid material such as steel, metal alloy, graphite, iron, brass, or aluminum.

Figure 4:
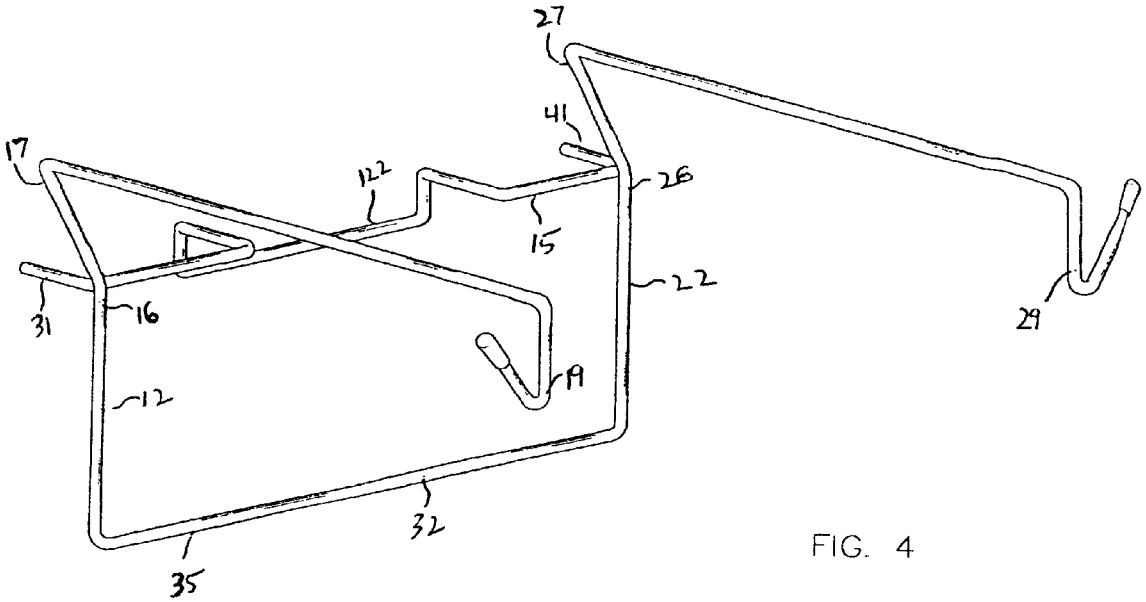
FIG. 4 is a perspective view of the present invention.
Figure 4A:
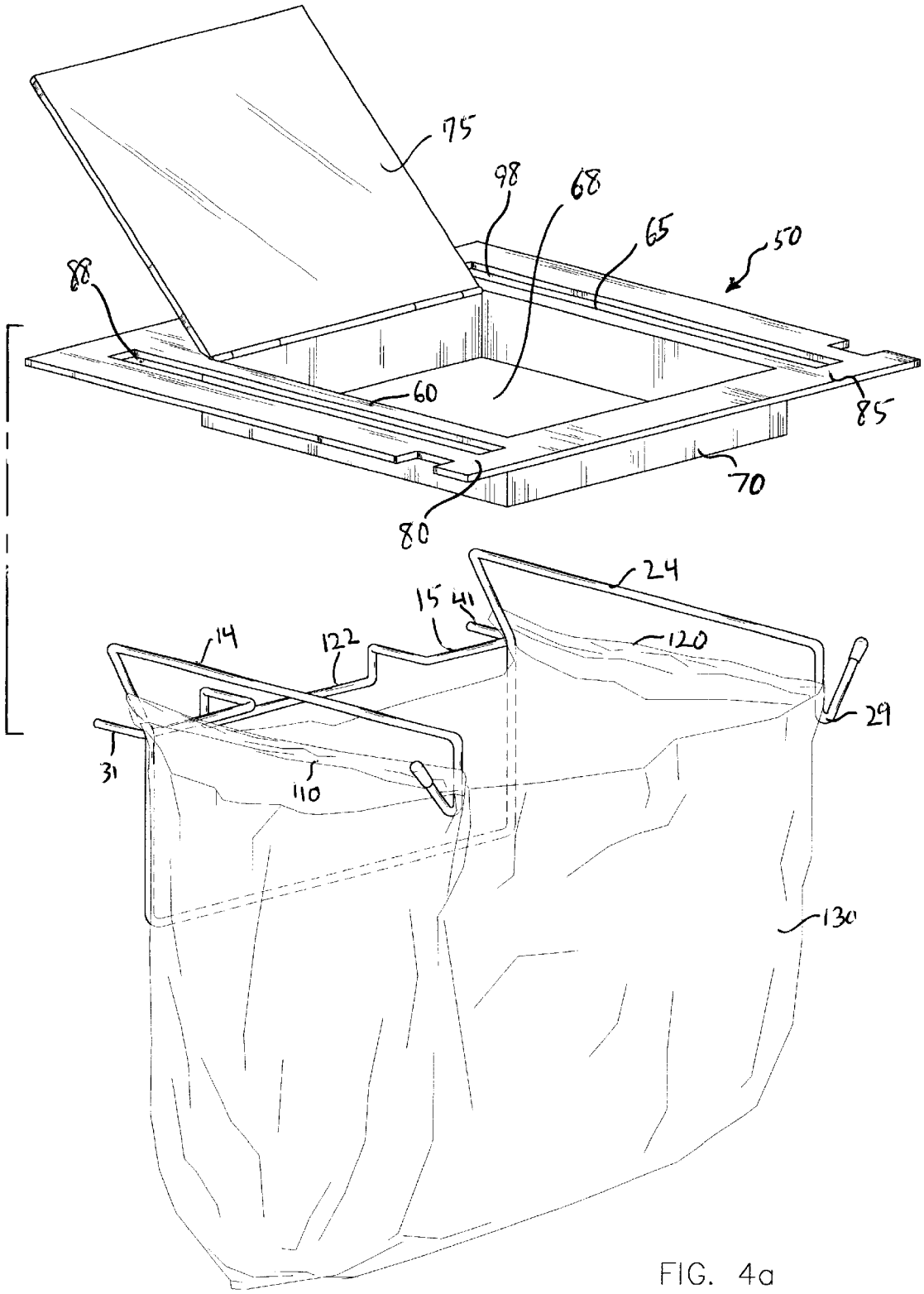
FIG. 4*a* is a perspective exploded view of the present invention with a plastic bag and a removeable cover member.
Figure 4B:
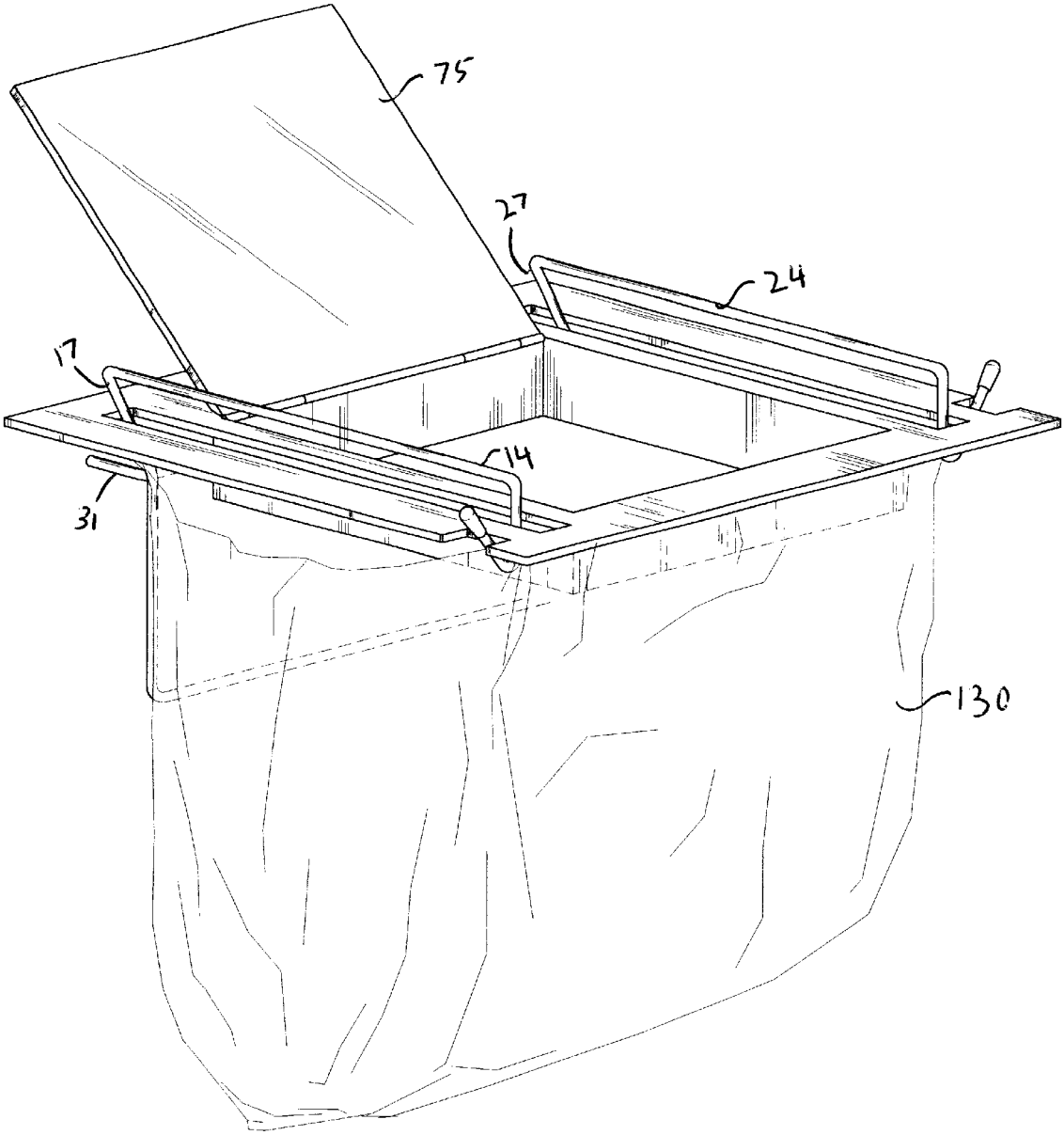
FIG. 4*b* is a perspective view of the present invention holding a plastic bag with the cover member thereon.

For each embodiment, the holder 10 can further comprise a removeable cover member 50 as shown in FIGS. 4 and 4*a*. The cover member 50 comprises a sheet 55 of durable and rigid material having a pair of opposed edges central portion thereof, and a rim 70 protrudes downwardly along the edge of the opening 68. A lid 75 for exposing and covering the opening 68 is hingeably mounted to the sheet 55 adjacent an edge of the opening. A pair of shoulders 80, 85 laterally extend from the opposed edges 60, 65 for engaging a corresponding arm member 12, 22. Furthermore, each shoulder can have an elongated slit 88, 98 defined thereon to allow the corresponding arm member 14, 24 to pass therethrough.

Although a preferred embodiment of the invention has been described and illustrated for purposes of clarity and example, it should be understood that many changes, substitutions and modifications to the described embodiment will be apparent to those having skill in the art in light of the foregoing disclosure without departing from the scope and spirit of the present invention which is defined by the claims which follow.

What is claimed as being new and therefore desired to be protected by letters patent of the United States is as follows:

1. A holder for hanging on a rim of miscellaneous items and for holding bags having a pair of opposed upwardly extendable loop handles, said holder comprising:

a pair of elongated vertical side members;

a brace member horizontally connecting said pair of vertical side members, an arm member forwardly extending from an upper end of each of said side members;

said arm member being formed into an upwardly extending horizontally elongated tab with a rearwardly projecting protrusion and a bent nose;

said brace member having rearwardly and downwardly extending middle portion for hooking onto said rim of miscellaneous items;

a removeable cover member, said cover member comprising:

a sheet of durable rigid material having a pair of opposed edges and having an opening defined in the central portion thereof;

a rim protruding downwardly along the edge of said opening;

a lid for covering said opening hingeably mounted to said sheet adjacent an edge of said opening; and a pair of shoulders laterally extending from said opposed edges for engaging a corresponding arm member; and, whereby a user places each of said looped handles of the bag on a corresponding of said arm portion tabs.

2. A holder as described in claim 1 wherein each shoulder has an elongated slit for allowing said corresponding arm member to pass therethrough.

3. A holder as described in claim 1 further comprising a support bar connecting said lower ends of said side members.

4. A holder for hanging on rims of miscellaneous items and for holding bags having a pair of opposed upwardly extendable loop handles, said holder comprising:

a continuous wire bent to form a spaced pair of upwardly extending vertical side members;

an arm member forwardly extending from an upper end of each of said side members, said arm member being formed into an upwardly extending horizontally elongated tab with a rearwardly projecting protrusion and a bent nose;

each side member having an elongated rod member protruding rearwardly and downwardly at a predetermined distance from said arm member for hooking onto said rim of miscellaneous items;

a removeable cover member, said cover member comprising:

a sheet of durable rigid material having a pair of opposed edges and having an opening defined in the central portion thereof;

a rim protruding downwardly along the edge of said opening;

a lid for covering said opening hingeably mounted to said sheet adjacent an edge of said opening; and a pair of shoulders laterally extending from said opposed edges for engaging a corresponding arm member; and, whereby a user places each of said looped handles of the bag on a corresponding one of said arm portion tabs.

5. A holder as described in claim 4 wherein each shoulder has an elongated slit for allowing said corresponding arm member to pass therethrough.

6. A holder as described in claim 4 further comprising a brace member connecting said side members.

7. A holder as described in claim 6 wherein said brace member further comprises a rearwardly and downwardly extending middle portion for hooking onto said rim of miscellaneous items.

8. A holder for hanging on rims of miscellaneous items and for holding bags having a pair of opposed upwardly extendable loop handles, said holder comprising a continuous wire bent to form a spaced pair of upwardly extending vertical side members;

an arm member forwardly extending from an upper end of each of said side members, said arm member being formed into an upwardly extending horizontally elongated tab with a rearwardly projecting protrusion and a bent nose;

a brace member horizontally connecting said pair of vertical side members at a predetermined distance below said arm member;

a means for hooking said holder onto said rim of miscellaneous items;

a removeable cover member, said cover member comprising:

a sheet of durable rigid material having a pair of opposed edges and having an opening defined in the central portion thereof;

a rim protruding downwardly along the edge of said opening;

a lid for covering said opening hingeably mounted to said sheet adjacent an edge of said opening; and a pair of shoulders laterally extending from said opposed edges for engaging a corresponding arm member; and, whereby a user places each of said looped handles of the bag on a corresponding one of said arm portion tabs.

9. A holder as described in claim 8 wherein each shoulder has an elongated slit for allowing said corresponding arm member to pass therethrough.

10. A holder as described in claim 8 wherein brace member comprises a rearwardly and downwardwardly extending middle portion for hooking onto said rim of miscellaneous items.

11. A holder as described in claim 8 wherein said means for hooking said holder onto rims of miscellaneous items comprises two or more spaced rod members extending rearwardly and downwardly from said brace member.

12. A holder for hanging on a rim of miscellaneous items and for holding bags having a pair of opposed upwardly extendable loop handles, said holder comprising:

a pair of elongated vertical side members;

a brace member horizontally connecting said pair of vertical side members;

an arm member forwardly extending from an upper end of each of said side members;

said arm member being formed into an upwardly extending horizontally elongated tab with a rear portion near said corresponding side member having a rearwardly projecting protrusion and an opposed front portion having a downwardly extending segment leading to an upwardly angled end segment;

said brace member having rearwardly and downwardwardly extending middle portion for hooking onto said rim of miscellaneous items, and;

whereby a user places each of said looped handles of the bag on a corresponding one of said arm portion tabs.

13. A holder for hanging on rims of miscellaneous items and for holding bags having a pair of opposed upwardly extendable loop handles, said holder comprising:

a continuous wire bent to form a spaced pair of upwardly extending vertical side members;

an arm member forwardly extending from an upper end of each of said side members, said arm member being formed into an upwardly extending horizontally elongated tab with a rear portion near said corresponding side member having a rearwardly projecting protrusion and an opposed front portion having a downwardly extending segment leading to an upwardly angled end segment;

each side member having an elongated rod member protruding rearwardly and downwardly at a predetermined distance from said arm member for hooking onto said rim of miscellaneous items; and, whereby a user places each of said looped handles of the bag on a corresponding one of said arm portion tabs.

14. A holder for hanging on rims of miscellaneous items and for holding bags having a pair of opposed upwardly extendable loop handles, said holder comprising:

a continuous wire bent to form a spaced pair of upwardly extending vertical side members;

an arm member forwardly extending from an upper end of each of said side members, said arm member being formed into an upwardly extending horizontally elongated tab with a rear portion near said corresponding side member having a rearwardly projecting protrusion and an opposed front portion having a downwardly extending segment leading to an upwardly angled end segment;

a brace member horizontally connecting said pair of vertical side members at a predetermined distance below said arm member;

a means for hooking said holder onto said rim of miscellaneous items; and, whereby a user places each of said looped handles of the bag on a corresponding one of said arm portion tabs.

15. A holder as described in claim 12 further comprising a support bar connecting said lower ends of said side members.

16. A holder as described in claim 12 further comprising a rod member extending perpendicularly and rearwardly from each end of said brace member.

17. A holder as described in claim 13 further comprising a brace member connecting said side members.

18. A holder as described in claim 13 wherein said brace member further comprises a rearwardly and downwardwardly extending middle portion for hooking onto said rim of miscellaneous items.

19. A holder as described in claim 14 wherein brace member comprises a rearwardly and downwardwardly extending middle portion for hooking onto said rim of miscellaneous items.

20. A holder as described in claim 14 wherein said means for hooking said holder onto rims of miscellaneous items comprises two or more spaced rod members extending rearwardly and downwardly from said brace member.

* * * * *